United States Patent [19]

Matsuzaki et al.

[11] Patent Number: 4,632,493

[45] Date of Patent: Dec. 30, 1986

[54] ELECTRIC CONNECTOR RECEPTACLE AND A METHOD OF PRODUCING THE SAME

[75] Inventors: Shuichi Matsuzaki, Chofu; Akira Nakazawa, Yokohama, both of Japan

[73] Assignee: Hirose Electric Co., Ltd., Tokyo, Japan

[21] Appl. No.: 775,239

[22] Filed: Sep. 12, 1985

[30] Foreign Application Priority Data

Apr. 1, 1985 [JP] Japan ..... 60-68660

[51] Int. Cl.[4] ..... H01R 13/40

[52] U.S. Cl. ..... 339/176 M; 29/842; 339/17 LC

[58] Field of Search ..... 339/17 LC, 17 C, 176 M, 339/276 SF; 29/842, 844, 845

[56] References Cited

U.S. PATENT DOCUMENTS

| | | | |
|---|---|---|---|
| 4,040,699 | 8/1977 | Rasmussen | 339/176 M |
| 4,193,654 | 3/1980 | Hughes et al. | 339/17 LC |
| 4,210,376 | 7/1980 | Hughes et al. | 339/17 LC |
| 4,261,633 | 4/1981 | Abernethy | 339/176 M |
| 4,556,264 | 12/1985 | Tanaka | 339/176 M |

FOREIGN PATENT DOCUMENTS 55-37800 3/1980 Japan .

*Primary Examiner*—John McQuade

*Attorney, Agent, or Firm*—Fleit, Jacobson, Cohn & Price

[57] ABSTRACT

An electric connector receptacle comprises an insulating housing having a plug inserting end, a rear end on the side opposite thereto, a plug inserting hole extending inwardly from the plug inserting end and four side walls surrounding the plug inserting hole, and a plurality of contacts arranged at intervals in the insulating housing. Each contact has a spring contact portion, an intermediate portion, and a mounting portion. The insulating housing has a plurality of compartment grooves which receive, from the side of the rear end, the connecting portions of the spring contact portions and the intermediate portions of the contacts at positions adjacent to the plug inserting end inside the side wall, contact inserting holes that lead from the rear end to the plurality of compartment grooves, and a plurality of vertical mounting grooves near the rear end to receive the mounting portions of the contacts from the side of the rear end. The front ends of the vertical mounting grooves serve as positioning grooves which receive the ends of the spring contact portions of the contacts and place them in position.

7 Claims, 15 Drawing Figures

ELECTRIC CONNECTOR RECEPTACLE AND A METHOD OF PRODUCING THE SAME

BACKGROUND OF THE INVENTION

1. Field of the Invention

The present invention relates to an electric connector receptacle, and particularly to an electric connector receptacle adapted to a modular connector that is used for telephone sets, measuring instruments, and the like, and to a method of producing the same.

2. Description of the Prior Art

In recent years, small and cheaply constructed connectors called modular connectors have been much used in the telephone sets, measuring instruments, data processors, and small computers. A modular connector of this kind has been disclosed in Japanese Patent Laid-Open No. 37800/1980. As shown in a perspective view of FIG. 14 and a section view of FIG. 15 in the accompanying drawings, this modular connector consists of a modular connector receptacle 10 and a modular connector plug 20. An insulating housing 11 of the modular connector receptacle 10 is made of a plastic material, and is mounted on a printed board by a mounting leg 13. The insulating housing 11 has a plug inserting end 11A, a rear end 11B, and a plug inserting hole 12 which stretches inwardly from the plug inserting end 11A. The plug inserting hole 12 is surrounded by an inner lower wall 12A, an inner upper wall 12B and a pair of inner side walls 12C. The insulating housing 11 further has an outer lower wall 13A, an outer upper wall 13B, and a pair of outer side walls 13C. The outer lower wall 13A has the mounting leg 13 formed as a unitary structure. The mounting leg 13 is inserted in a hole formed in the printed board 30, so that the connector receptacle 10 is mechanically mounted on the printed board 30.

The insulating housing 11 is provided with a plurality of recessed portions 14 arranged between the inner upper wall 12B and the outer upper wall 13B at the plug inserting end 11A. These recessed portions 14 are connected to a plurality of grooves 15 formed in the outer upper wall 13B. Grooves 15 in the outer upper wall 13B are separated by partitioning walls 15A. Grooves 15 and partitioning walls 15A stretch beyond the rear end 11B of housing 11 down to a lower portion of the outer lower wall 13A. The plug inserting hole 12 has a retainer surface 16. In the insulated housing 11 are arranged a plurality of contacts 17 in parallel at intervals. Each contact 17 has a slender intermediate portion 17A which stretches across the outer upper wall 13B and which is downwardly curved at a portion 17B. The intermediate portion 17A has a tail portion 17C which downwardly stretches across the rear end 11B of the insulating housing 11. A spring contact portion 17D of the contact 17 protrudes aslantly into the plug inserting hole 12 from the curved portion 17B that is placed in the recessed portion 14. The rear end of tail portion 17C of each contact 17 protrudes beyond the outer lower wall 13A, and is soldered to a conductor of the printed board 30.

The inner lower wall 12A has a central recessed portion 18 which is tilted downwardly and which stretches to the plug inserting end 11A. A pair of shoulder portions are provided on both sides of the central recessed portion 18 to define a retainer surface 16. The shoulder portions are directed to the rear end 11B of housing 11 to engage with shoulder portions of a latch arm 21 of the plug connector 20.

As shown well in FIG. 15, the plug 20 is inserted in the plug inserting hole 12 of connector receptacle 10 mounted on the printed board 30, so that shoulder portions of the latch arm 21 engage with the retainer surface 16. Then, the plug 20 is coupled to the connector receptacle 10 with the spring contact portions 17D of contacts 17 being electrically contacted to the corresponding contact portions 22 of the plug 20.

The electric connector receptacle of the type mentioned above has the latch member 21 positioned under the plug connector 20. Therefore, there is no likelihood that the latch member is accidentally depressed, and the plug 20 is removed from the receptacle 10. Further, the connector receptacle is of the construction which cannot be easily tinkered with by a child, and the plug 20 will not be removed from the receptacle 10 unexpectedly. The connector receptacle, however, has problems as described below.

That is, in the conventional connector receptacle 10, the contacts 17 arranged in the insulating housing 11 run in a manner to surround the upper wall of housing starting from the rear end 11B of the insulating housing 11, passing on the upper wall 13B down to a portion under the inner upper wall 12B. Therefore, it is difficult to insert the contacts 17 into the insulating housing 11 after they have been folded into a predetermined shape. According to the conventional connector receptacle, therefore, the contact members are arranged at predetermined positions on the insulating housing, and are then folded into a predetermined shape, requiring very cumbersome operation and increased periods of time, causing the cost of the connector to increase. According to the conventional connector receptacle, furthermore, the intermediate portions 17A of contacts 17 are completely exposed in the grooves 15, presenting the probability of accident such as short-circuit amont the contacts when dust and dirt are built up thereon.

The object of the present invention, therefore, is to provide an electric connector receptacle while eliminates the above-mentioned problems inherent in the conventional art, and a method of producing such an electric connector receptacle.

SUMMARY OF THE INVENTION

According to an aspect of the present invention, in an electric connector receptacle of the type comprising an insulating housing which has a plug inserting end, a rear end on the side opposite thereto, a plug inserting hole that extends inwardly from the plug inserting end, and four side walls surrounding the plug inserting hole, and a plurality of contacts arranged at intervals in the insulating housing, wherein each of the contacts has a spring contact portion which aslantly stretches in the plug inserting hole toward the rear end from one of the side walls to the opposing side wall at a position adjacent to the plug inserting end, has an intermediate portion which stretches from the plug inserting end toward the rear end along the side wall, and has a mounting portion which stretches nearly vertically from one of the side walls to the opposing wall at a position adjacent to the rear end, and wherein the plug inserting hole has such a size as to accept the plug connector which has a plurality of contact members that come into engagement with the spring contact portions, the insulating housing has a plurality of compartment grooves which receive, from the side of the rear end, the connecting portions of the spring contact portions and the intermediate portions of the contacts at positions adjacent to the plug inserting end inside the side wall, has contact inserting holes that lead from the rear end to the plurality of compartment grooves, and further has a plurality of vertical mounting grooves near the rear end to receive the mounting portions of the contacts from the side of the rear end, and wherein the front ends of the vertical mounting grooves serve as positioning grooves which receive the ends of the spring contact portions of the contacts and place them in position.

According to another aspect of the present invention, there is provided a method of producing an electric connector receptacle as mentioned above, comprising the steps of forming each of the contacts having the spring contact portion, the intermediate portion and the mounting portion by folding a contact material into a predetermined shape; and thereafter inserting each of the formed contacts through the corresponding contact inserting holes of the insulating housing to be arranged in the insulating housing.

The invention will be described below in further detail by way of an embodiment in conjunction with FIGS. 1 to 13 of the accompanying drawings.

DESCRIPTION OF THE PREFERRED EMBODIMENTS

Figure 1:
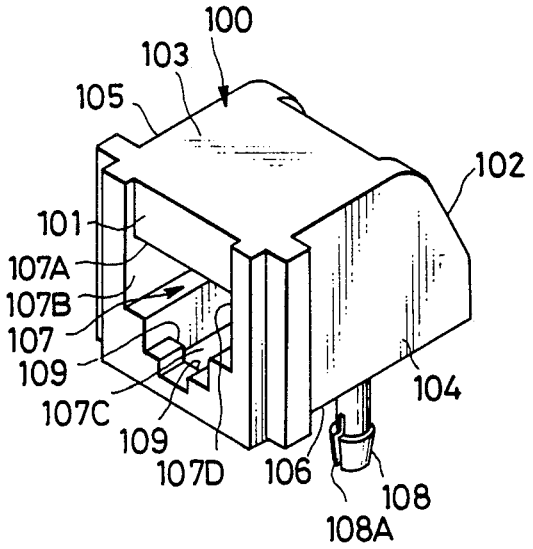
FIG. 1 is a perspective view of an electric connector receptacle according to an embodiment of the present invention when seen from the front side.

As shown in the drawings FIGS. 1 through 9, the electric connector receptacle according to this embodiment is equipped with an insulating housing 100 made of an insulating material such as a plastic as a unitary structure, and a plurality of contacts 200 and 300 arranged in the insulating housing 100 at intervals.

The insulating housing 100 has a plug inserting end 101, a rear end 102 on the opposite side, a plug inserting hole 107 which inwardly stretches from the plug inserting end 101, and four side walls, i.e., upper side wall 103, right side wall 104, left side wall 105 and lower side wall 106 that surround the plug inserting hole 107. The lower side wall 106 of insulating housing 100 has a pair of mounting legs 108 that are formed as a unitary structure. The mounting legs 108 are provided with a slit 108A so that they can resiliently engage with mounting holes formed in the printed board.

Figure 7:
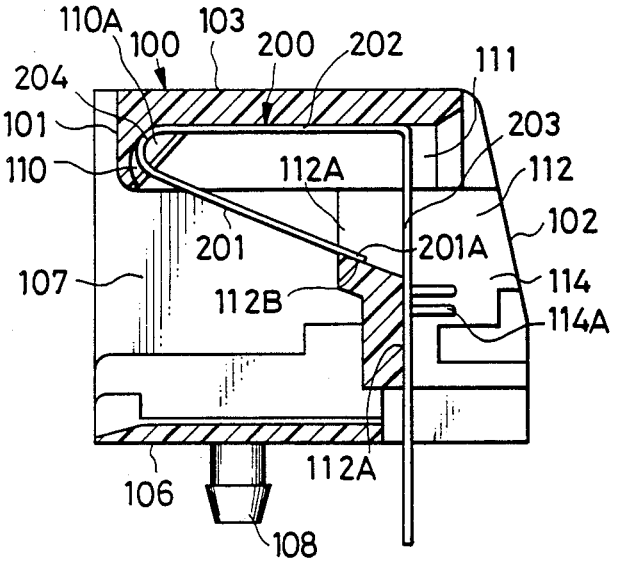
FIG. 7 is a section view along the line 7'—7" of FIG. 6, and shows the arrangement of contacts.
Figure 8:
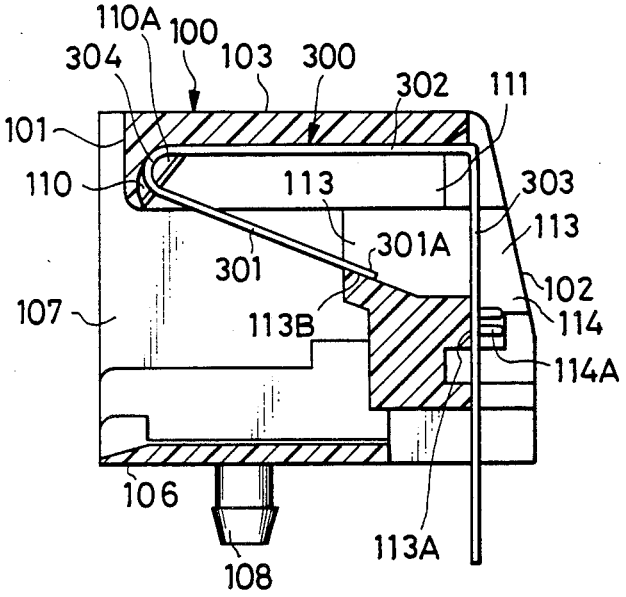
FIG. 8 is a section view along the line 8'—8" of FIG. 6, and shows the arrangement of contacts.

According to this embodiment, two kinds of contacts having slightly different shapes are arranged in the insulating housing 100. As best shown in FIG. 7, the contact 200 of one kind has a spring contact portion 201 which aslantly stretches in the plug inserting hole 107 from the upper side wall 103 toward the opposing lower side wall 106 at a position adjacent to the plug inserting end 101 of insulating housing 100, an intermediate portion 202 which stretches from the plug inserting end 101 toward the rear end 102 along the upper side wall 103, and a mounting portion 203 which stretches vertically from the upper side wall 103 to the lower side wall 106 at a position adjacent to the rear end 102. The contact 300 of the other kind, as best shown in FIG. 8, has a spring contact portion 301, an intermediate portion 302 and a mounting portion 303 like the contact 200. Here, what makes a difference from the contact 200 is that the mounting portion 303 is bent from the intermediate portion 302 at a position closer to the rear end 102 than a position at which the mounting portion 203 of the contact 200 is bent from the intermediate portion 202.

Figure 14:
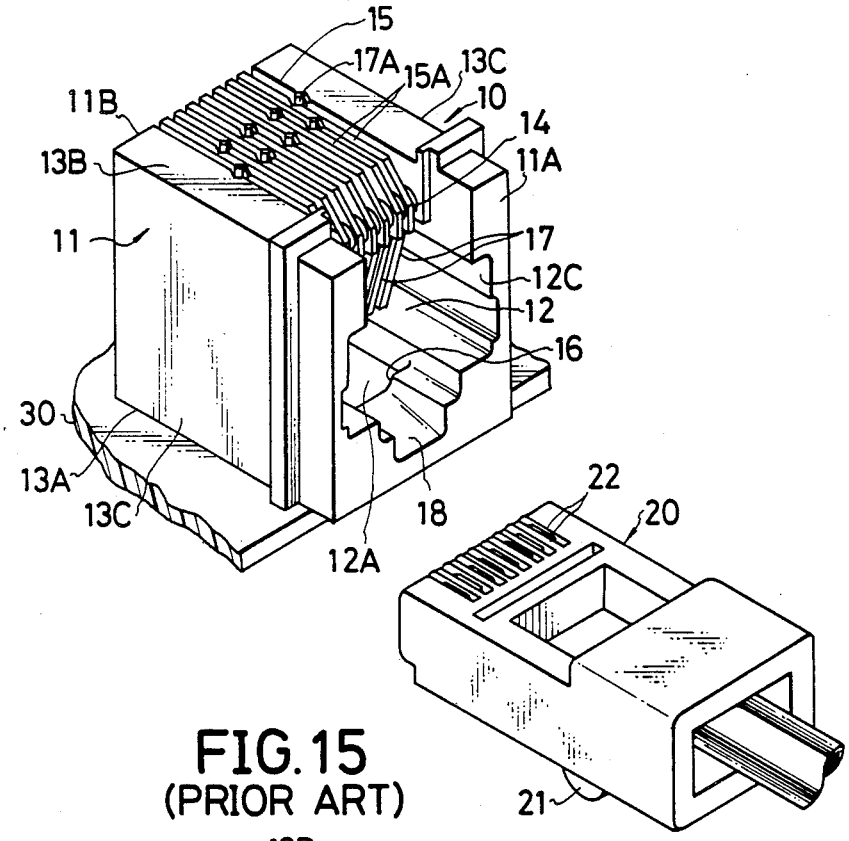
FIG.14 (PRIOR ART)
FIG. 14 is a perspective view showing a conventional modular connector.
Figure 15:
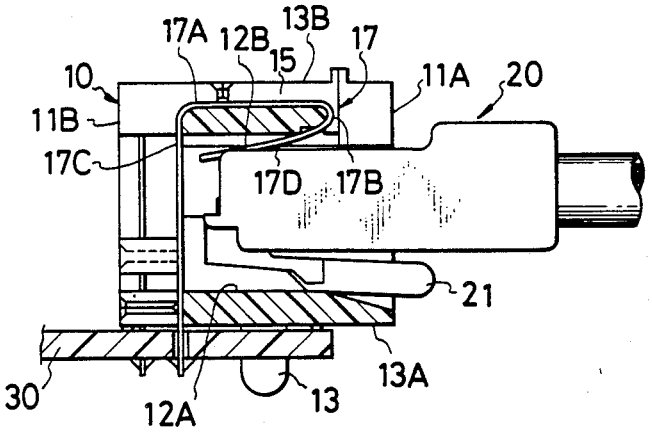
FIG.15 (PRIOR ART)
FIG. 15 is a section view showing the condition where the connector of FIG. 14 is coupled.

Peripheral walls 107A, 107B, 107C and 107D defining the plug inserting hole 107 have such a size as to receive a plug connector 400 (see FIG. 10) which is similar to the conventional plug 200 shown in FIGS. 14 and 15, and which has a plurality of contact members that come into engagement with the spring contact portions 201 and 301. A retainer surface 109 is formed on both sides at the front end of the peripheral wall 107C like the conventional connector receptacle 10, so as to engage with a shoulder portion of latch arm 401 of the plug connector 400.

Figure 9:
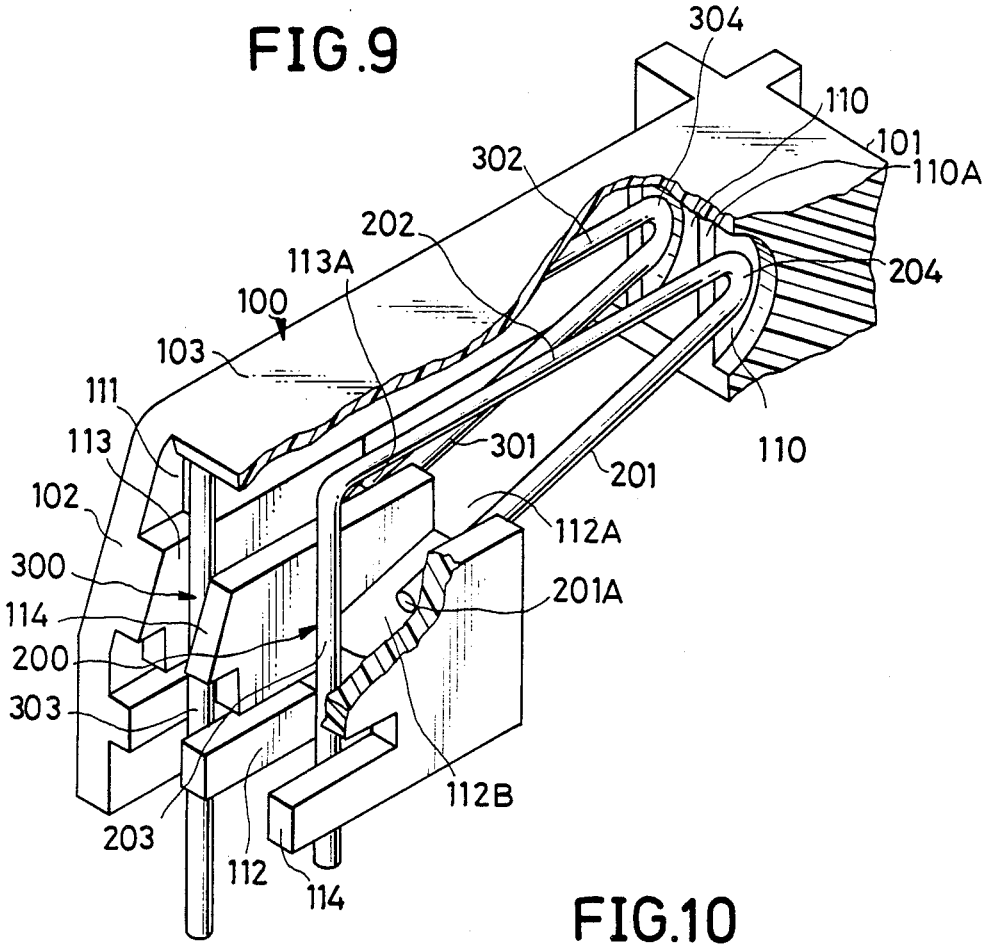
FIG. 9 is a rear perspective view showing, on an enlarged scale, the arrangement of contacts by cutting away a portion of the electric connector receptacle of FIG. 1.

As best shown in FIG. 9, furthermore, the insulating housing 100 has a plurality of, or in this embodiment four compartment grooves 110 to receive, from the direction of rear end 102, the connection portions 204, 304 between the spring contact portions 201, 301 and the intermediate portions 202, 302 of contacts 200 and 300, at positions adjacent to the plug inserting end 101 on the inside of the upper side wall 103, the compartment grooves 110 being isolated from each other by partitioning walls 110A. The insulating housing 100 is further provided with contact inserting holes 111 that lead from the rear end 102 to the four compartment grooves 110.

Near the rear end 102 of the insulating housing, furthermore, there are provided four vertical mounting grooves 112 and 113 to receive the mounting portions 203, 303 of contacts 200 and 300 from the rear end 102. As shown well in FIGS. 7 and 8, the front wall 112A of vertical mounting groove 112 is formed at a position considerably remote from the rear end 102 so that the mounting portion 203 of contact 200 of one kind will come into contact therewith. The front wall 113A of vertical mounting groove 113 is formed at a position close to the rear end 102 so that the mounting portion 303 of contact 300 of the other kind will come into contact therewith. Partitioning walls 114 of vertical mounting grooves 112 and 113 should be provided with projections 114A to temporarily secure the mounting portions 203 and 303. Front ends of the vertical mounting grooves 112 and 113 serve as positioning grooves 112A and 113A to receive ends 201A and 301A of spring contact portions 201, 301 of contact 200 and 300, and to place them in position. Bottoms 112B and 113B of these positioning grooves 112A and 113A define a position to which will come into contact the ends 201A and 301A of spring contact portions 201, 301 of contacts 200 and 300.

Figure 2:
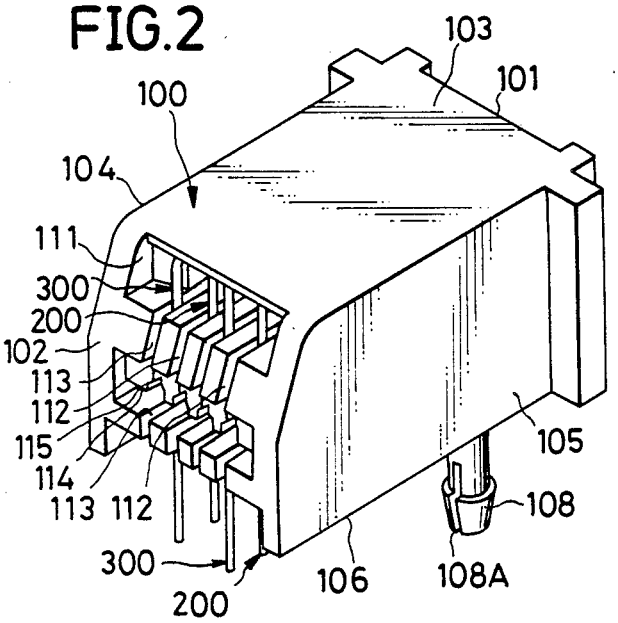
FIG. 2 is a perspective view when seen from the rear side.
Figure 3:
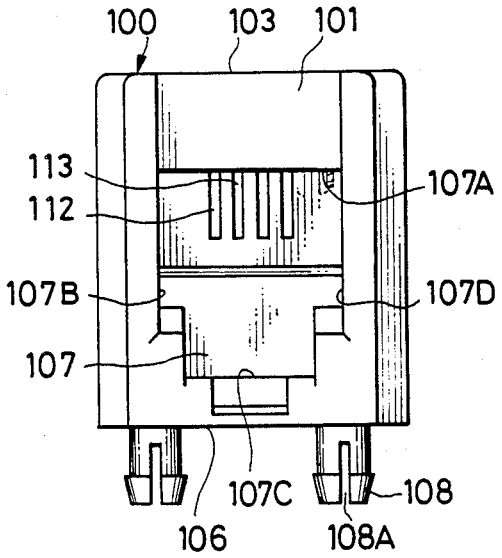
FIG. 3 is a front view of an insulating housing of the electric connector receptacle of FIG. 1.
Figure 4:
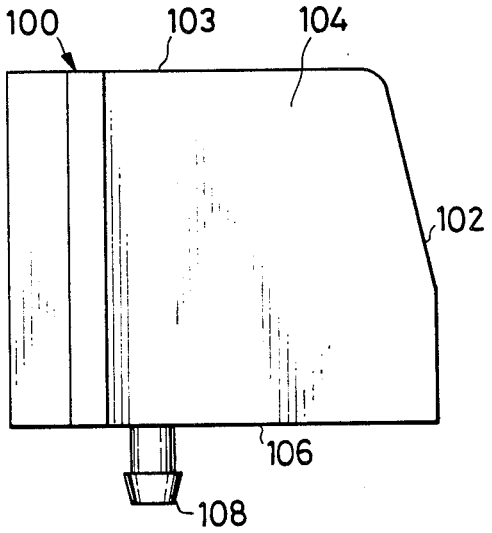
FIG. 4 is a side view of FIG. 3.
Figure 5:
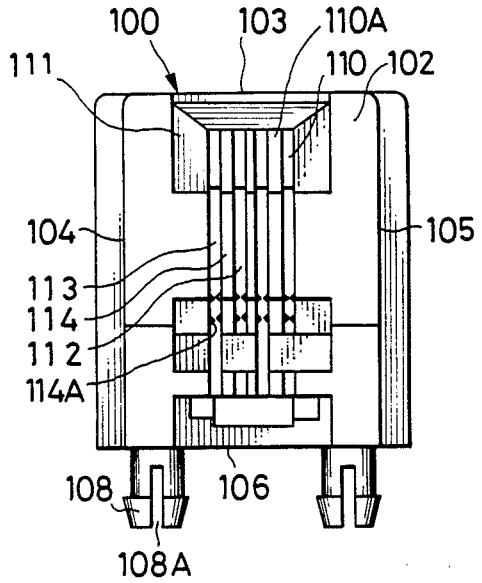
FIG. 5 is a rear view of FIG. 3.
Figure 6:
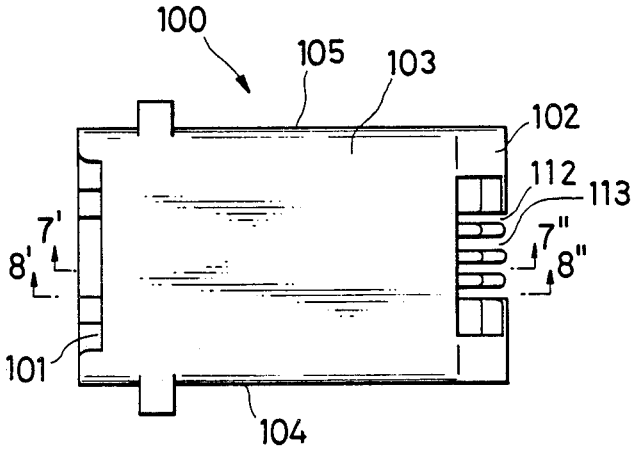
FIG. 6 is a plan view of FIG. 3.

As shown well in FIG. 2, mounting portions 203 and 303 of contacts 200 and 300 arranged in the insulating housing 100 of the aforementioned construction are fastened to the insulating housing 100 by crushing the partitioning walls 114 of vertical mounting grooves 112 and 113 by the thermal caulking as designated at reference numeral 115. The mounting portions may be fastened to the insulating housing by charging a suitable adhesive agent into the vertical mounting grooves 112 and 113, instead of effecting the thermal caulking.

Figure 10:
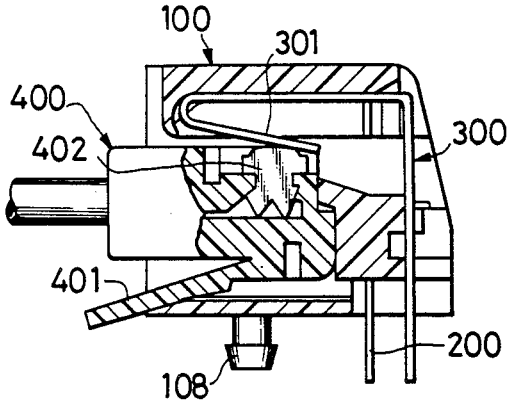
FIG. 10 is a section view showing the condition where the electric connector receptacle of FIG. 1 and the plug connector are coupled together.

As shown in a section view of FIG. 10, the plug connector 400 is inserted in the plug inserting hole of the electric connector receptacle 100 until the shoulder portion of latch arm 401 engages with the retainer surface 109. Then, the electric connector receptacle 100 and the plug connector 400 are coupled together with the contact portions 402 of the plug connector 400 being electrically contacted to the spring contact portions 201 and 301 of contacts 200 and 300.

Described below is an embodiment of a method of producing the electric connector receptacle according to the present invention.

Figure 11:
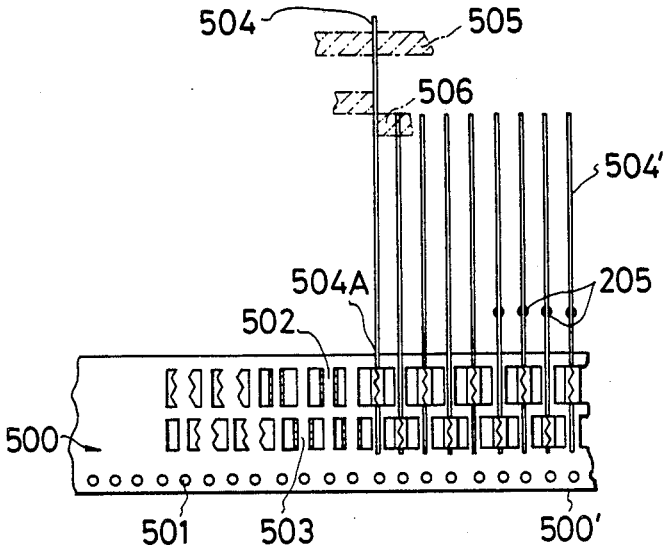
FIG. 11 is a schematic view showing the step of crimping for preparing the contact reel prior to putting the production method of the embodiment of the present invention into practice.
Figure 12:
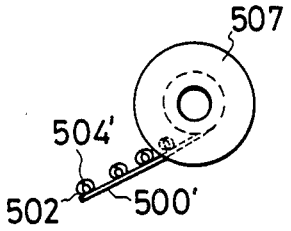
FIG. 12 is a schematic view showing the step for taking up the reel after the step of crimping of FIG. 11.
Figure 13:
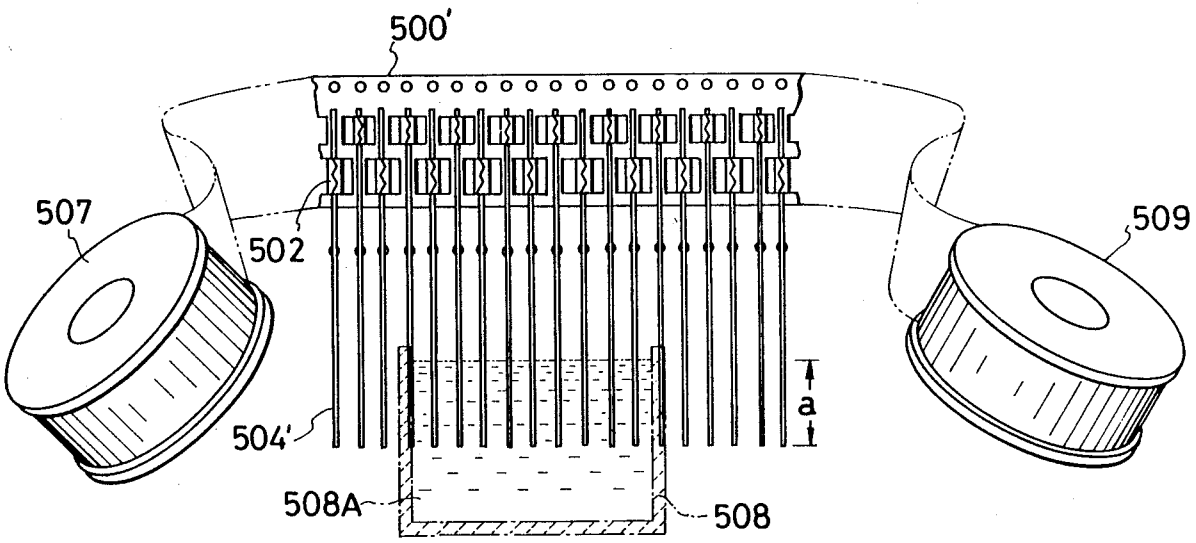
FIG. 13 is a schematic view showing the step of plating after the step of taking up the reel.

FIG. 11 schematically shows the step for producing a contact reel prior to putting the production method of the present invention into practice. As schematically shown in FIG. 11, first, a contact reel is prepared to obtain contacts 200 of one kind that are to be arranged in the insulating housing 100 of the electric connector receptacle of the invention mentioned above. A metal reel member 500 is subjected to the pressing to continuously form carrier perforation 501, first-stage crimping portions 502 and second-stage crimping portions 503 maintaining a predetermined pitch (which is equal to the arrangement pitch of vertical mounting grooves 112 or is equal to the arrangement pitch of vertical mounting grooves 113). Ends of continuous contact members 504 which have not been particularly treated, e.g., which have not been plated with gold, are sent onto the first-stage crimping portions 502 or onto the second-stage crimping portions 503 via a feeder 505 and a cutting punch 506. The first-stage crimping portions 502 are then crimped to the ends of contact members 504 which are then cut by the cutting punch 506 at a predetermined distance from the ends 504A where they are fastened; i.e., the contact members 504 are crimped to the first-stage crimping portion 502. The predetermined distance refers to that the contacts 200 of one kind shown well in FIG. 7 are just formed by the step of folding. Next, a portion corresponding to a predetermined position of mounting portion of contact 200 is subjected to the pressing to form an engaging protuberance 205 which bites into the partitioning wall 114 of vertical mounting groove 112 or 113 to stop when the contact 200 is to be arranged in the insulating housing 100. The above-mentioned steps are repeated to form contact members 504' that are crimped to a series of first-stage crimping portions 502 and second-stage crimping portions 503. The metal reel 500' carrying these contact members 504' is wound on a reel 507 as schematically shown in FIG. 12. In the next stage, the metal reel 500' having a series of crimping portions 502 to which the contact members 504' are crimped is drawn from the reel 507 that was prepared in the above-mentioned stage. Only the tips a of contact members 504' are immersed in a gold-plating liquid 508A in a plating bath 508, so that the tips a only are plated with gold. The metal reel 500' is taken up again by a reel 509. The tips a correspond to the spring contact portions 201 of the contacts 200.

Next, another contact reel is prepared to obtain contacts 300 of the other kind that are to be arranged in the insulating housing 100 of the aforementioned electric connector receptacle of the present invention. The contact reel is prepared in the same manner as the contact reel for obtaining contacts 200, except the below-mentioned point, and is not hence described in further detail. Here, the contact members to be crimped to the contact reel to obtain the contacts 300 are longer than those for obtaining the contacts 200, so that the contacts 300 of the shape shown well in FIG. 8 can be obtained by folding. Namely, to increase the length of the contact members 504', position of the cutting punch should be changed and, further, the position of engaging protuberance should be changed.

Described below is the method of producing the electric connector receptacle according to the embodiment of the invention using the thus prepared contact reel for obtaining contacts 200 and the contact reel for obtaining contacts 300. First, the insulating housing 100 mentioned earlier is molded using a plastic as a unitary structure. The contact members 504' are then continuously supplied from the contact reel to obtain contacts 200. Namely, the contact members 504' are bent to obtain contacts 200 having spring contact portion 201, intermediate portion 202 and mounting portion 203 as shown well in FIG. 7. According to this embodiment, the two contacts 200 are folded and are then inserted together through contact inserting holes 111 at the rear end 102 of the insulating housing 100, so that connecting portions 204 between the spring contact portion 201 and the intermediate portion 202 are fitted into every other compartment grooves 110 and that the mounting portions 203 are arranged in the corresponding vertical mounting grooves 112 as shown in FIG. 7. The contact members 504' are then cut away from the reel at the fastened portions 504A. Next, likewisely, the contact members are continuously supplied from the contact reel to obtain contacts 300. The contact members are folded to obtain the contacts 300 which are then inserted through the contact inserting holes 111 of the insulating housing 100, so as to be arranged as shown in FIG. 8. The contact members are then cut away from the reel at the fastened portions. Finally, partitioning walls 114 of the vertical mounting grooves 112 and 113 of the insulating housing 100 are crushed by the thermal caulking as mentioned earlier, to fasten the contacts 200 and 300 to the insulating housing 100. The contacts may be fastened by charging an adhesive agent into the vertical mounting grooves 112 and 113, instead of relying upon the thermal caulking.

According to the electric connector receptacle of the construction contemplated by the present invention as mentioned earlier, the contacts are folded to predetermined shapes and are then easily inserted in the insulated housing. Therefore, the contacts can be arranged very simply, enabling the connector to be produced at a reduced cost. According to the electric connector receptacle of the present invention, furthermore, intermediate portions of the contacts are completely covered by the side wall, and are not exposed upwardly. Therefore, dust and dirt do not build up thereon, and accident such as short-circuit amont the contacts is prevented from occurring.

We claim:

1. In an electric connector receptacle of the type comprising: an insulating housing which has a plug inserting end, a rear end on the side opposite thereto, a plug inserting hole that stretches inwardly from said plug inserting end, and four side walls surrounding said plug inserting hole; and a plurality of contacts arranged at intervals in said insulating housing; wherein each of said contacts has a spring contact portion which aslantly stretches in said plug inserting hole toward said rear end from one of said side walls to the opposing side wall at a position adjacent to said plug inserting end, has an intermediate portion which stretches from said plug inserting end toward said rear end along said one side wall, and has a mounting portion which stretches vertically from one of said side walls to said opposing wall at a position adjacent to the rear end, and wherein said plug inserting hole has such a size as to accept the plug connector which has a plurality of contact members that come into engagement with said spring contact portions, the improvement wherein, said insulating housing has a plurality of compartment grooves which receive, from the side of said rear end, the connecting portions of said spring contact portions and said intermediate portions of said contacts at positions adjacent to said plug inserting end inside the one side wall, has contact inserting holes that lead from said rear end to said plurality of compartment grooves, and further has a plurality of vertical mounting grooves near said rear end to receive said mounting portions of said contacts from the side of said rear end, and wherein the front ends of said vertical mounting grooves serve as positioning grooves which receive the ends of said spring contact portions of said contacts and place them in position.

2. An electric connector receptacle according to claim 1, wherein said intermediate portion of each of said contacts is substantially covered by said one side wall.

3. An electric connector receptacle according to claim 1, wherein the bottom of said positioning groove serves as a position to which the end of said spring contact portion comes in contact.

4. An electric connector receptacle according to claim 1, wherein the mounting portions of said contacts are fastened to said insulating housing by thermally caulking the partitioning walls of said vertical mounting grooves.

5. An electric connector receptacle according to claim 1, wherein the mounting portions of said contacts are fastened to said insulating housing by charging an adhesive into said vertical mounting grooves.

6. In a method of producing an electric connector receptacle of the type which comprises: an insulating housing which has a plug inserting end, a rear end on the side opposite thereto, a plug inserting hole that stretches inwardly from said plug inserting end, and four side walls surrounding said plug inserting hole; and a plurality of contacts arranged at intervals in said insulating housing; wherein each of said contacts has a spring contact portion which aslantly stretches in said plug inserting hole toward said rear end from one of said side walls to the opposing side wall at a position adjacent to said plug inserting end, has an intermediate portion which stretches from said plug inserting end toward said rear end along said one side wall, and has a mounting portion which stretches nearly vertically from said one of said side walls to said opposing wall at a position adjacent to the rear end, and wherein said plug inserting hole has such a size as to accept the plug connector which has a plurality of contact members that come into engagement with said spring contact portions, and wherein, said insulating housing has a plurality of compartment grooves which receive, from the side of said rear end, the connecting portions of said spring contact portions and said intermediate portions of said contacts at positions adjacent to said plug inserting end inside the one side wall, has contact inserting holes that lead from said rear end to said plurality of compartment grooves, and further has a plurality of vertical mounting grooves near said rear end to receive said mounting portions of said contacts from the side of said rear end, and wherein the front ends of said vertical mounting grooves serve as positioning grooves which receive the ends of said spring contact portions of said contacts and place them in position, said method comprising the steps of forming each of the contacts having the spring contact portion, the intermediate portion and the mounting portion by folding a contact member into a predetermined shape; and thereafter inserting each of the formed contacts through the corresponding contact inserting holes of the insulating housing to be arranged in the insulating housing.

7. A method of producing an electric connector receptacle according to claim 6, wherein said contact members are attached at the ends on one side to a reel member maintaining a predetermined pitch, and are cut away from said reel member at said attached ends after the contacts are folded, inserted and arranged in said insulating housing.

* * * * *